US010823334B2

(12) United States Patent
Wang et al.

(10) Patent No.: US 10,823,334 B2
(45) Date of Patent: Nov. 3, 2020

(54) HYDRAULIC PRESSURIZATION DEVICE FOR LIQUEFIED NATURAL GAS AND LIQUEFIED-COMPRESSED NATURAL GAS

(71) Applicant: Zigong Tongda Machinery Manufacturing Co., Ltd, Sichuan (CN)

(72) Inventors: Yiguan Wang, Zigong (CN); Pinzhong Zhao, Zigong (CN); Guangdi Chen, Zigong (CN); Zongrong Wu, Zigong (CN); Jianbing Zeng, Zigong (CN)

(73) Assignee: Zigong Tongda Machinery Manufacturing Co., Ltd, Sichuan (CN)

( * ) Notice: Subject to any disclaimer, the term of this patent is extended or adjusted under 35 U.S.C. 154(b) by 357 days.

(21) Appl. No.: 15/974,061

(22) Filed: May 8, 2018

(65) Prior Publication Data

US 2019/0003645 A1 Jan. 3, 2019

(30) Foreign Application Priority Data

Jun. 29, 2017 (CN) ..... 2017 1 0512466

(51) Int. Cl.
*F17C 5/02* (2006.01)
*F17C 7/02* (2006.01)
(Continued)

(52) U.S. Cl.
CPC ..... *F17C 5/02* (2013.01); *B67D 7/36* (2013.01); *B67D 7/62* (2013.01); *B67D 7/72* (2013.01);
(Continued)

(58) Field of Classification Search
CPC ..... F17C 5/02; F17C 7/02; F17C 2223/0161; F17C 2227/0192; F17C 2225/0123;
(Continued)

(56) References Cited

U.S. PATENT DOCUMENTS 7,069,730 B2 * 7/2006 Emmer ..... F17C 5/007 141/11
2010/0139777 A1 * 6/2010 Whiteman ..... F17C 5/007 137/14
(Continued)

FOREIGN PATENT DOCUMENTS

CN 201184495 Y 1/2009
CN 102927437 A 2/2013
CN 204164652 U 2/2015

OTHER PUBLICATIONS

Chinese Office Action received in Chinese Application No. 201710512466.3 dated Jan. 4, 2018.

*Primary Examiner* — Marina A Tietjen
(74) *Attorney, Agent, or Firm* — Knobbe, Martens, Olson & Bear, LLP

(57) ABSTRACT

The disclosed technology generally relates to liquefied natural gas (LNG) and liquefied-compressed natural gas (L-CNG) filling stations, and more particularly to an LNG/L-CNG hydraulic pressurization device and a gas filling station. In one aspect, a LNG/L-CNG hydraulic pressurization device includes an oil tank; a L-CNG pressurization cylinder; a LNG pressurization cylinder; first and second directional valves communicating with the L-CNG pressurization cylinder and the LNG pressurization cylinder respectively; a first hydraulic pump and a second hydraulic pump, whose oil inlets communicate with the oil tank and whose pressure oil outlets communicate with an oil inlet of the first directional valve and an oil inlet of the second directional valve respectively; and a ball valve having a first port communicating with a first communication port between the pressure oil outlet of the first hydraulic pump and the oil inlet of the first directional valve, and a second port communicating with a second communication port between the
(Continued)

pressure oil outlet of the second hydraulic pump and the oil inlet of the second directional valve.

20 Claims, 1 Drawing Sheet

(51) Int. Cl.

| | |
|---|---|
| ***B67D 7/36*** | (2010.01) |
| ***B67D 7/62*** | (2010.01) |
| ***B67D 7/72*** | (2010.01) |
| ***F15B 11/17*** | (2006.01) |

(52) U.S. Cl.
CPC ..... *F17C 7/02* (2013.01); *F17C 2221/033* (2013.01); *F17C 2223/013* (2013.01); *F17C 2223/0123* (2013.01); *F17C 2223/0161* (2013.01); *F17C 2223/035* (2013.01); *F17C 2225/013* (2013.01); *F17C 2225/0123* (2013.01); *F17C 2225/0161* (2013.01); *F17C 2225/033* (2013.01); *F17C 2225/035* (2013.01); *F17C 2227/0192* (2013.01); *F17C 2270/0581* (2013.01)

(58) Field of Classification Search
CPC ..... F17C 2225/035; F17C 2223/035; F17C 2223/0123; F17C 2225/0161; F17C 2225/033; F17C 2225/013; F17C 2223/013; F17C 2221/033; F17C 2270/0581; B67D 7/72; B67D 7/62; B67D 7/36; F15B 11/17
See application file for complete search history.

(56) References Cited

U.S. PATENT DOCUMENTS

| | | | | |
|---|---|---|---|---|
| 2014/0137572 | A1 | 5/2014 | Steffen | |
| 2014/0326000 | A1* | 11/2014 | Sampson ..... | F17C 9/00 62/49.1 |
| 2014/0338370 | A1 | 11/2014 | Barker | |

* cited by examiner

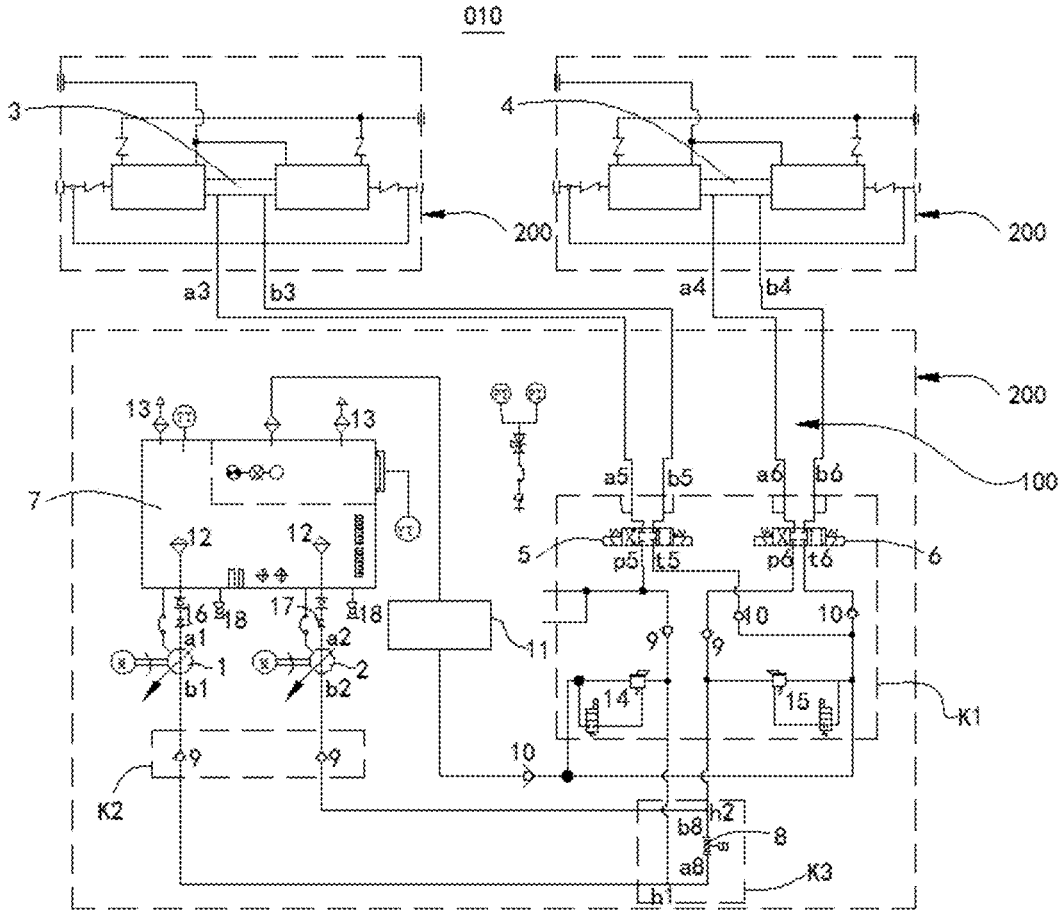
010
3
4
200
200
a3
b3
a4
b4
200
100
13
13
7
12
12
a5
b5
a6
b6
5
p5
t5
p6
t6
6
16
18
17
18
a1
a2
1
2
b1
b2
11
9
9
10
10
14
15
K1
9
9
10
K2
h2
b8
8
a8
K3
h1

HYDRAULIC PRESSURIZATION DEVICE FOR LIQUEFIED NATURAL GAS AND LIQUEFIED-COMPRESSED NATURAL GAS

CROSS-REFERENCE TO RELATED APPLICATIONS

This application claims foreign priority to Chinese Patent Application No. CN201710512466.3, entitled "LNG/L-CNG Hydraulic Pressurization Device and Gas Filling Station" filed with the Chinese Patent Office on Jun. 29, 2017, the content of which is incorporated herein by reference in its entirety.

BACKGROUND

Field

The disclosed technology generally relates to the technical field of liquefied natural gas (LNG) and liquefied-compressed natural gas (L-CNG) filling stations, and more particularly to an LNG/L-CNG hydraulic pressurization device and a gas filling station.

Description of the Related Technology

An LNG/L-CNG hydraulic pressurization device is a device used in an LNG/L-CNG filling station, for fueling of LNG or filling of L-CNG.

The existing LNG/L-CNG hydraulic pressurization devices commonly use submersible pumps and plunger pumps as power sources, and the fueling of LNG and the filling of L-CNG during use thereof have the problems of low working efficiency and slow filling speed.

SUMMARY OF CERTAIN INVENTIVE ASPECTS

Embodiments of the present disclosure provide an LNG/L-CNG hydraulic pressurization device to solve the problems of low working efficiency, high energy consumption, and slow filling speed of the LNG/L-CNG pressurization devices in the prior art.

Embodiments of the present disclosure further provide an LNG/L-CNG filling station equipped with the LNG/L-CNG hydraulic pressurization device described above.

The present disclosure is implemented as follows:

In one aspect, a LNG/L-CNG hydraulic pressurization device comprises: a first hydraulic pump, a second hydraulic pump, a liquefied-compressed natural gas (L-CNG) pressurization cylinder, a liquefied natural gas (LNG) pressurization cylinder, a first directional valve, a second directional valve, an oil tank, and a ball valve. The first hydraulic pump has an oil inlet and a pressure oil outlet. The second hydraulic pump has an oil inlet and a pressure oil outlet. The L-CNG pressurization cylinder has an oil inlet and an oil outlet. The LNG pressurization cylinder has an oil inlet and an oil outlet. The first directional valve is a three-position four-way valve, and the first directional valve has an oil inlet, a first oil outlet, a second oil outlet, and an oil return port. The second directional valve is a three-position four-way valve, and the second directional valve has an oil inlet, a third oil outlet, a fourth oil outlet, and an oil return port. The ball valve has a first port and a second port.

In some embodiments, the oil inlet of the first hydraulic pump communicates with the oil tank, the pressure oil outlet of the first hydraulic pump communicates with the oil inlet of the first directional valve, the first oil outlet and the second oil outlet of the first directional valve communicate with the oil inlet and the oil outlet of the L-CNG pressurization cylinder respectively, and the oil return port of the first directional valve communicates with the oil tank.

In some embodiments, the oil inlet of the second hydraulic pump communicates with the oil tank, the pressure oil outlet of the second hydraulic pump communicates with the oil inlet of the second directional valve, the third oil outlet and the fourth oil outlet of the second directional valve communicate with the oil inlet and the oil outlet of the LNG pressurization cylinder respectively, and the oil return port of the second directional valve communicates with the oil tank.

In some embodiments, the first port of the ball valve communicates with a first communication port between the pressure oil outlet of the first hydraulic pump and the oil inlet of the first directional valve, and the second port of the ball valve communicates with a second communication port between the pressure oil outlet of the second hydraulic pump and the oil inlet of the second directional valve.

When the ball valve is closed, the LNG/L-CNG hydraulic pressurization device has two pressurization oil lines connected in parallel, wherein the first pressurization oil line is an oil line through which the L-CNG pressurization cylinder is pressurized by the first hydraulic pump, the second pressurization oil line is an oil line through which the LNG pressurization cylinder is pressurized by the second hydraulic pump, and the two oil lines can be operated in parallel to pressurize the L-CNG pressurization cylinder and the LNG pressurization cylinder simultaneously, so as to achieve fueling of LNG and filling of CNG simultaneously; when the ball valve is opened, the first directional valve and the second directional valve can be controlled such that one of them is opened and the other of them is closed, so that the pressure oil outlets of the first hydraulic pump and the second hydraulic pump together pressurize the L-CNG pressure cylinder or the LNG pressure cylinder to improve the pressurization efficiency. The LNG/L-CNG hydraulic pressurization device in the present embodiment can optimally distribute the power of the first hydraulic pump and the second hydraulic pump by the ball valve as required according to respective requirements of the LNG pressurization cylinder and the L-CNG pressurization cylinder, and has the beneficial effects of high working efficiency, low energy consumption, and reduced equipment cost in the equipment investment. In addition, the L-CNG pressurization cylinder uses hydraulic pumps instead of a low-temperature submersible pump, which does not need a vacuum pump sump, does not need to be precooled, has a short process pipelines and has a fast filling speed; and the L-CNG pressurization cylinder is hydraulically driven, instead of being driven by a traditional crank slider mechanism, having a higher reliability, can work with one pump or double pumps, and enables a larger pressurized flow.

In one embodiment of the present disclosure, the oil tank is in communication with an oil return pipeline, the oil return pipeline communicates with the oil return port of the first directional valve and the oil return port of the second directional valve, and a first overflow valve is connected between the oil inlet of the first directional valve and the oil return pipeline.

In one embodiment of the present disclosure, a second overflow valve is connected between the oil inlet of the second directional valve and the oil return pipeline.

In one embodiment of the present disclosure, the first directional valve, the second directional valve, the first overflow valve, and the second overflow valve are integrated on a first valve plate.

In one embodiment of the present disclosure, each of the first overflow valve and the second overflow valve is a normally closed electromagnetic overflow valve.

In one embodiment of the present disclosure, oil lines between the pressure oil outlet of the first hydraulic pump and the first communication port, between the first communication port and the oil inlet of the first directional valve, between the pressure oil outlet of the second hydraulic pump and the second communication port, and between the second communication port and the oil inlet of the second directional valve are each provided with a first one-way valve.

In one embodiment of the present disclosure, two first one-way valves respectively between the pressure oil outlet of the first hydraulic pump and the first communication port and between the pressure oil outlet of the second hydraulic pump and the second communication port are integrated on a second valve plate.

In one embodiment of the present disclosure, an oil return pipeline communicating with the oil tank, a pipeline communicating with the oil return port of the first directional valve and the oil return pipeline, and a pipeline communicating with the oil return port of the second directional valve and the oil return pipeline are each provided with a second one-way valve.

In one embodiment of the present disclosure, the oil return port of the first directional valve and the oil return port of the second directional valve are both connected with the oil tank through a cooler.

In one embodiment of the present disclosure, the oil return port of the first directional valve and the oil return port of the second directional valve both communicate with an oil input end of the oil return pipeline through pipelines, an oil output end of the oil return pipeline communicates with the oil tank, and the cooler is disposed in the oil return pipeline.

In one embodiment of the present disclosure, the oil return pipeline is provided with an air discharge opening.

In one embodiment of the present disclosure, the oil tank is provided with an air filter for communicating with atmosphere.

In one embodiment of the present disclosure, two filters are disposed in the oil tank, and the first hydraulic pump and the second hydraulic pump communicate with the oil tank through the two filters, respectively.

In one embodiment of the present disclosure, the ball valve is integrated on a third valve plate and has four connection ports.

In one embodiment of the present disclosure, a first shutoff valve is disposed at the oil inlet of the first hydraulic pump; and a second shutoff valve is disposed at the oil inlet of the second hydraulic pump.

In one embodiment of the present disclosure, an oil drain ball valve is also disposed at the bottom of the oil tank.

In one embodiment of the present disclosure, an LNG/L-CNG filling station comprises a skid-mounted frame and the LNG/L-CNG hydraulic pressurization device of any one of the embodiments described above; the LNG/L-CNG hydraulic pressurization device is skid-mounted on the skid-mounted frame.

To sum up, the LNG/L-CNG hydraulic pressurization device in the embodiments of the present disclosure has the beneficial effects of high working efficiency, low energy consumption, reduced equipment cost in the equipment investment, fast filling speed, and higher reliability.

The LNG/L-CNG filling station in the present embodiment, using the LNG/L-CNG hydraulic pressurization device described previously, also has the above beneficial effects. Moreover, due to the design of being skid-mounted, the LNG/L-CNG pressurization device in the present embodiment also has the beneficial effects of being highly integrated, occupying a small area, being put into use quickly, and facilitating transporting and transferring thereof.

BRIEF DESCRIPTION OF THE DRAWINGS

For illustrating technical solutions in specific embodiments of the present disclosure or in the prior art more clearly, a drawing required for the description of the specific embodiments or the prior art will be introduced briefly below. It is apparent that the drawing below is illustrative of some embodiments of the present disclosure. It would be understood by those skilled in the art that other relevant drawings could also be obtained from the drawing without any inventive effort.

FIG. 1 is a schematic structural diagram of an LNG/L-CNG hydraulic pressurization device in accordance with embodiments of the present disclosure;

Reference numerals: 1—first hydraulic pump; 2—second hydraulic pump; 3—L-CNG pressurization cylinder; 4—LNG pressurization cylinder; 5—first directional valve; 6—second directional valve; 7—oil tank; 8—ball valve; 9—first one-way valve; 10—second one-way valve; 11—cooler; 12—filter; 13—air filter; 14—first overflow valve; 15—second overflow valve; 16—first shutoff valve; 17—second shutoff valve; 18—oil drain ball valve; a1—oil inlet; b1—pressure oil outlet; a2—oil inlet; b2—pressure oil outlet; a3—oil inlet; b3—oil outlet; a4 oil inlet; b4—oil outlet; p5—oil inlet; a5—first oil outlet; b5—second oil outlet; t5—oil return port; p6—oil inlet; a6—third oil outlet; b6—fourth oil outlet; t6—oil return port; a8—first port; b8—second port; h1—first communication port; h2—second communication port; 010—LNG/L-CNG filling station; 100—LNG/L-CNG hydraulic pressurization device; 200—skid-mounted frame; K1—first valve plate; K2—second valve plate; K3—third valve plate.

DETAILED DESCRIPTION OF CERTAIN ILLUSTRATIVE EMBODIMENTS

In order to make the objects, technical solutions and advantages of the embodiments of the present disclosure more clear, the technical solutions of the embodiments of the present disclosure will be described below clearly and completely with reference to the drawings of the embodiments of the present disclosure. It is apparent that the embodiments described are some, but not all of the embodiments of the present disclosure. Generally, the components of the embodiments of the present disclosure, as described and illustrated in the figures herein, may be arranged and designed in a wide variety of different configurations.

Thus, the following detailed description of the embodiments of the present disclosure, as represented in the figures, is not intended to limit the scope of the present disclosure as claimed, but is merely representative of selected embodiments of the present disclosure. All the other embodiments obtained by those skilled in the art in light of the embodiments of the present disclosure without inventive efforts would fall within the scope of the present disclosure as claimed.

It should be noted that similar reference numerals and letters refer to similar items in the following figures, and thus once an item is defined in one figure, it may not be further defined or explained in the following figures.

In the description of the present disclosure, it should be stated that terms such as "first" and "second", if present, are used only for distinguishing the description, and should not be understood as indicating or implying to have importance in relativity.

Embodiments

FIG. 1 is a schematic structural diagram of an LNG/L-CNG pressurization device 100 in accordance with embodiments of the present disclosure. Referring to FIG. 1, an LNG/L-CNG filling station 010 in accordance with the present embodiment comprises an LNG/L-CNG hydraulic pressurization device 100. The LNG/L-CNG hydraulic pressurization device 100 is skid-mounted on a skid-mounted frame 200. The LNG/L-CNG hydraulic pressurization device 100 being skid-mounted to the skid-mounted frame 200 enables a highly integrated structure, achieving the advantages of occupying a small area, being put into use quickly and facilitating transportation and transferring thereof.

Continuing to refer to FIG. 1, the LNG/L-CNG hydraulic pressurization device 100 in accordance with the present embodiment comprises a first hydraulic pump 1, a second hydraulic pump 2, an L-CNG pressurization cylinder 3, an LNG pressurization cylinder 4, a first directional valve 5, a second directional valve 6, an oil tank 7, and a ball valve 8.

The first hydraulic pump 1 has an oil inlet al and a pressure oil outlet b1; the second hydraulic pump 2 has an oil inlet a2 and a pressure oil outlet b2; the L-CNG pressurization cylinder 3 has an oil inlet a3 and an oil outlet b3; the LNG pressurization cylinder 4 has an oil inlet a4 and an oil outlet b4; the first directional valve 5 is a three-position four-way valve, and the first directional valve 5 has an oil inlet p5, a first oil outlet a5, a second oil outlet b5 and an oil return port t5; the second directional valve 6 is a three-position four-way valve, and the second directional valve 6 has an oil inlet p6, a third oil outlet a6, a fourth oil outlet b6, and an oil return port t6; and the ball valve 8 has a first port a8 and a second port b8.

The oil inlet al of the first hydraulic pump 1 communicates with the oil tank 7, the pressure oil outlet b1 communicates with the oil inlet p5 of the first directional valve 5, the first oil outlet a5 and the second oil outlet b5 of the first directional valve 5 communicate with the oil inlet a3 and the oil outlet b3 of the L-CNG pressurization cylinder 3 respectively, and the oil return port t5 of the first directional valve 5 communicates with the oil tank 7 to form a first pressurization circuit, so that oil in the oil tank 7 may enter the oil inlet p5 from the pressure oil outlet b1 after being pressurized by the first hydraulic pump 1, and the pressure oil enters the oil inlet a3 of the L-CNG pressurization cylinder 3 when the oil inlet p5 of the first directional valve 5 is controlled to communicate with the first oil outlet a5, therefore the L-CNG pressurization cylinder 3 may be pressurized by controlling an oil line by the first directional valve 5; and the first pressurization circuit can also be disconnected by closing the first directional valve 5, thereby stopping the pressurization of the L-CNG pressurization cylinder 3.

The oil inlet a2 of the second hydraulic pump 2 communicates with the oil tank 7, the pressure oil outlet b2 communicates with the oil inlet p6 of the second directional valve 6, the third oil outlet a6 and the fourth oil outlet b6 of the second directional valve 6 communicate with the oil inlet a4 and the oil outlet b4 of the LNG pressurization cylinder 4 respectively, and the oil return port t6 of the second directional valve 6 communicates with the oil tank 7 to form a second pressurization circuit, so that the oil in the oil tank 7 may enter the oil inlet p6 from the pressure oil outlet b2 after being pressurized by the second hydraulic pump 2, and the pressure oil enters the oil inlet a4 of the LNG pressurization cylinder 4 when the oil inlet p6 of the second directional valve 6 is controlled to communicate with the third oil outlet a6, therefore the LNG pressurization cylinder 4 may be pressurized by controlling the oil line by the second directional valve 6; and the second pressurization circuit can also be disconnected by closing the second directional valve 6, thereby stopping the pressurization of the LNG pressurization cylinder 4.

The pressure oil outlet b1 of the first hydraulic pump 1 communicates with the oil inlet p5 of the first directional valve 5 through a pipeline, the pipeline between the pressure oil outlet b1 of the first hydraulic pump 1 and the oil inlet p5 of the first directional valve 5 is provided with a first communication port h1, the pressure oil outlet b2 of the second hydraulic pump 2 communicates with the oil inlet p6 of the second directional valve 6 through a pipeline, and the pipeline between the pressure oil outlet b2 of the second hydraulic pump 2 and the oil inlet p6 of the second directional valve 6 is provided with a second communication port h2.

Referring to FIG. 1, the first port a8 of the ball valve 8 communicates with the first communication port h1 between the pressure oil outlet b1 of the first hydraulic pump 1 and the oil inlet p5 of the first directional valve 5, and the second port b8 of the ball valve 8 communicates with the second communication port h2 between the pressure oil outlet b2 of the second hydraulic pump 2 and the oil inlet p6 of the second directional valve 6.

When the ball valve 8 is closed, the LNG/L-CNG hydraulic pressurization device 100 in the embodiment has two pressurization oil lines connected in parallel, that is, the first pressurization oil line is an oil line through which the L-CNG pressurization cylinder 3 is pressurized by the first hydraulic pump 1, and the second pressurization oil line is an oil line through which the LNG pressurization cylinder 4 is pressurized by the second hydraulic pump 2, and the two oil lines can be operated in parallel to pressurize the L-CNG pressurization cylinder 3 and the LNG pressurization cylinder 4 simultaneously so as to achieve fueling of LNG and filling of CNG simultaneously; when the ball valve 8 is opened, the first directional valve 5 and the second directional valve 6 can be controlled such that one of them is opened and the other of them is closed, so that the pressure oil outlet b1 of the first hydraulic pump 1 and the pressure oil outlet b2 of the second hydraulic pump 2 together pressurize the L-CNG pressure cylinder 3 or the LNG pressure cylinder 4 to improve the pressurization efficiency.

In one embodiment of the present disclosure, the oil lines between the pressure oil outlet b1 of the first hydraulic pump 1 and the first communication port h1, between the first communication port h1 and the oil inlet p5 of the first directional valve 5, between the pressure oil outlet b2 of the second hydraulic pump 2 and the second communication port h2, and between the second communication port h2 and the oil inlet p6 of the second directional valve 6 each communicate with a first one-way valve 9, to avoid backflow of the oil in the oil lines described above, so that the oil can flow back only through an oil return pipeline, making the two pressurization circuits more stable. Optionally, an oil return pipeline communicating with the oil tank 7, a pipeline communicating with the oil return port t5 of the first directional valve 5, and a pipeline communicating with the oil return port t6 of the second directional valve 6 are each connected with a second one-way valve 10, so that the oil in the oil return pipeline can only flow to the oil tank 7 in a one-way manner, thereby avoiding the oil in the oil tank 7 from entering the pressurization cylinder and affecting the pressurization effect.

In one embodiment of the present disclosure, in order to avoid overheating of an oil liquid used in the oil line(s), the oil return port t5 of the first directional valve 5 and the oil return port t6 of the second directional valve 6 are both connected to the oil tank 7 through a cooler 11. The cooler is disposed in the oil return pipeline, that is to say, the hydraulic oil flowing back through each of the oil return port t5 and the oil return port t6 is first cooled by the cooler 11 and then flows back into the oil tank 7. The cooler 11 here may be an air cooler, or may also be other cooler such as a water cooler. In this case, the oil return pipeline connected to the oil tank 7 is provided with an air discharge opening, by which air in the oil line(s) may be discharged at any time, so that it is safer during the hydraulic pressurization.

In an embodiment of the present disclosure, in order to ensure the cleanliness of the hydraulic oil line, the oil tank 7 is provided therein with filters 12, with the first hydraulic pump 1 and the second hydraulic pump 2 communicating with the filters respectively. Two filters 12 are both disposed in the oil tank 7, and the two filters 12 are connected to the oil inlet a1 of the first hydraulic pump 1 and the oil inlet a2 of the second hydraulic pump 2 respectively, so that the oil liquid enters hydraulic circulation only after being filtered by the filters 12, which can avoid the occurrence of faults such as blocked pipelines. In addition, in some examples, the oil tank 7 may communicate with atmosphere through air filter(s) 13 so that air entering the oil tank 7 is cleaned without contaminating the oil liquid, two air filters 13 may be provided, and the two air filters 13 may be symmetrically disposed at two ends of the top of the oil tank 7, so that the air within the oil tank 7 can be sufficiently and effectively purified.

In an embodiment of the present disclosure, a first overflow valve 14 is connected between the oil inlet p5 of the first directional valve 5 and the oil return pipeline. The first overflow valve 14 is a normally closed electromagnetic overflow valve. A second overflow valve 15 is connected between the oil inlet p6 of the second directional valve 6 and the oil return pipeline; and the second overflow valve 15 is a normally closed electromagnetic overflow valve. With the first overflow valve 14 and the second overflow valve 15, when oil pressures of the two pressurization oil lines are too high, the first overflow valve 14 or the second overflow valve 15 may be opened to allow the pressure oil to flow through the oil return pipeline back into the oil tank 7, thereby achieving the purpose of decreasing the oil pressures of the pressurization oil lines. By disposing the first overflow valve 14 and the second overflow valve 15, it is possible to limit the oil pressure of a high-pressure oil line in general cases, to ensure safe use and to achieve active unloading when required.

In the present embodiment, a first shutoff valve 16 is disposed at the oil inlet a1 of the first hydraulic pump 1; and a second shutoff valve 17 is disposed at the oil inlet a2 of the second hydraulic pump 2. The first shutoff valve 16 and the second shutoff valve 17 are each used for controlling communication with the oil tank 7 and disconnection with the oil tank 7. In addition, an oil drain ball valve 18 is also disposed at the bottom of the oil tank 7 for draining the oil liquid or impurities at a lower level from the oil tank 7, for example, when the oil tank 7 is being cleaned.

In order to facilitate the monitoring of the working state of the LNG/L-CNG hydraulic pressurization device 100 in the present embodiment, a display instrument may be disposed at the oil tank 7 or at other position of the pipelines in the present embodiment, and for example, a concentration measurement instrument for measuring the concentration of natural gas may be disposed in the oil tank 7, an oil pressure gauge may be disposed at the oil line, or the like.

In some embodiments, the first directional valve 5, the second directional valve 6, the first overflow valve 14, and the second overflow valve 15 may be integrated on a first valve plate K1, and the first one-way valve 9 directly connected to the first hydraulic pump 1 and the first one-way valve 9 directly connected to the second hydraulic pump 2 may be integrated to the second valve plate K2. The ball valve 8 may be disposed as a third valve plate K3 with four connection ports. The above integrations can increase the integration level of the system, facilitating the connection and arrangement of the pipelines and reducing the entire occupied area.

In the present embodiment, the valve elements such as the first directional valve 5, the second directional valve 6, the first overflow valve 14, and the second overflow valve 15 described previously, as well as the two first one-way valves 9 and the two second one-way valves 10 directly connected to the first directional valve 5 and the second directional valve 6 may be integrated on the first valve plate K1, to facilitate the arrangement and connection of the pipelines. The first one-way valve 9 directly connected to the first hydraulic pump 1 and the first one-way valve 9 directly connected to the second hydraulic pump 2 may be integrated to the second valve plate K2. The ball valve 8 may be disposed as a third valve plate K3 with four connection ports, to achieve the function of merging or separating the pressure oil outlet b1 of the first hydraulic pump 1 and the pressure oil outlet b2 of the second hydraulic pump 2. By integrating some structures to the first valve plate K1, the second valve plate K2 and the third valve plate K3, the integration level of the system can be increased, facilitating the connection and arrangement of the pipelines and reducing the entire occupied area.

The LNG/L-CNG hydraulic pressurization device 100 in the embodiment of the present disclosure has the following beneficial effects, among others:

1. The motor power is greatly reduced by power optimization configuration and reasonable power transmission form of the first hydraulic pump 1 and the second hydraulic pump 2. During use, energy consumption is reduced; and equipment cost is reduced in the equipment investment.
2. The L-CNG pressurization cylinder 3 employs hydraulic pump(s), instead of a low-temperature submersible pump, enabling no need of a vacuum pump sump, no need of being precooled, a short process pipeline and a fast filling speed.
3. The L-CNG pressurization cylinder 3 is hydraulically driven, instead of being driven by a traditional crank slider mechanism, and thus has a higher reliability, can work with one pump or double pumps, and enables a larger pressurized flow.
4. The hydraulic pressurization device is designed to be skid-mounted, and thus is highly integrated, occupies a small area, can be put into use quickly, and can be transported and transferred conveniently.

The above description is merely illustrative of preferred embodiments of the present disclosure and is not intended to limit the present disclosure. It would be understood by those skilled in the art that various modifications and variations can be made to the present disclosure. Any modifications, equivalent alternatives, improvements and so on made within the spirit and principle of the present disclosure should fall within the scope of protection of the present disclosure.

INDUSTRIAL APPLICABILITY

The LNG/L-CNG hydraulic pressurization device of the present disclosure has the beneficial effects of high working efficiency, low energy consumption, reduced equipment cost in the equipment investment, fast filling speed, and higher reliability, can be produced in large scale, is suitable for beign applied to industrial production, and has good application prospects, and the LNG/L-CNG filling station using the LNG/L-CNG hydraulic pressurization device described previously also has the beneficial effects described above. Moreover, due to the design of being skid-mounted, the LNG/L-CNG filling station also has a high integration level, occupies a small area, can be put into use quickly, can be transported and transferred conveniently, and is suitable for popularization and application.

What is claimed is:

1. A liquefied natural gas/liquefied-compressed natural gas (LNG/L-CNG) hydraulic pressurization device, comprising:

a first hydraulic pump having an oil inlet and a pressure oil outlet;

a second hydraulic pump having an oil inlet and a pressure oil outlet;

a liquefied-compressed natural gas (L-CNG) pressurization cylinder having an oil inlet and an oil outlet;

a liquefied natural gas (LNG) pressurization cylinder having an oil inlet and an outlet port;

a first directional valve that is a three-position four-way valve, the first directional valve comprising an oil inlet, a first oil outlet, a second oil outlet and an oil return port;

a second directional valve that is a three-position four-way valve, the second directional valve comprising an oil inlet, a third oil outlet, a fourth oil outlet and an oil return port;

an oil tank; and a ball valve having a first port and a second port, wherein the oil inlet of the first hydraulic pump communicates with the oil tank, the pressure oil outlet of the first hydraulic pump communicates with the oil inlet of the first directional valve, the first oil outlet and the second oil outlet of the first directional valve communicate with the oil inlet and the oil outlet of the L-CNG pressurization cylinder respectively, and the oil return port of the first directional valve communicates with the oil tank, wherein the oil inlet of the second hydraulic pump communicates with the oil tank, the pressure oil outlet of the second hydraulic pump communicates with the oil inlet of the second directional valve, the third oil outlet and the fourth oil outlet of the second directional valve communicate with the oil inlet and the oil outlet of the LNG pressurization cylinder respectively, and the oil return port of the second directional valve communicates with the oil tank, and wherein the first port of the ball valve communicates with a first communication port between the pressure oil outlet of the first hydraulic pump and the oil inlet of the first directional valve, and the second port of the ball valve communicates with a second communication port between the pressure oil outlet of the second hydraulic pump and the oil inlet of the second directional valve.

2. The LNG/L-CNG hydraulic pressurization device according to claim 1, wherein the oil tank communicates with an oil return pipeline, the oil return pipeline communicates with the oil return port of the first directional valve and the oil return port of the second directional valve, and a first overflow valve is connected between the oil return pipeline and the oil inlet of the first directional valve.

3. The LNG/L-CNG hydraulic pressurization device according to claim 2, wherein a second overflow valve is connected between the oil return pipeline and the oil inlet of the second directional valve.

4. The LNG/L-CNG hydraulic pressurization device according to claim 3, wherein the first directional valve, the second directional valve, the first overflow valve, and the second overflow valve are integrated onto a first valve plate.

5. The LNG/L-CNG hydraulic pressurization device according to claim 3, wherein each of the first overflow valve and the second overflow valve is a normally closed electromagnetic overflow valve.

6. The LNG/L-CNG hydraulic pressurization device according to claim 1, wherein first one-way valves are respectively provided in the oil lines between the pressure oil outlet of the first hydraulic pump and the first communication port, between the first communication port and the oil inlet of the first directional valve, between the pressure oil outlet of the second hydraulic pump and the second communication port, and between the second communication port and the oil inlet of the second directional valve.

7. The LNG/L-CNG hydraulic pressurization device according to claim 6, wherein two first one-way valves are integrated onto a second valve plate, with the two first one-way valves respectively between the pressure oil outlet of the first hydraulic pump and the first communication port and between the pressure oil outlet of the second hydraulic pump and the second communication port.

8. The LNG/L-CNG hydraulic pressurization device according to claim 1, wherein an oil return pipeline communicating with the oil tank, a pipeline communicating the oil return port of the first directional valve and the oil return pipeline, and a pipeline communicating the oil return port of the second directional valve and the oil return pipeline are each provided with a second one-way valve.

9. The LNG/L-CNG hydraulic pressurization device according to claim 1, wherein the oil return port of the first directional valve and the oil return port of the second directional valve are both connected to the oil tank through a cooler.

10. The LNG/L-CNG hydraulic pressurization device according to claim 9, wherein the oil return port of the first directional valve and the oil return port of the second directional valve each communicate with an oil input end of the oil return pipeline through a pipeline, an oil output end of the oil return pipeline communicates with the oil tank, and the cooler is provided in the oil return pipeline.

11. The LNG/L-CNG hydraulic pressurization device according to claim 10, wherein the oil return pipeline is provided with an air discharge opening.

12. The LNG/L-CNG hydraulic pressurization device according to claim 1, wherein the oil tank is provided with one or more air filters for communicating with atmosphere.

13. The LNG/L-CNG hydraulic pressurization device according to claim 1, wherein two filters are provided in the oil tank, and the first hydraulic pump and the second hydraulic pump communicate with the oil tank through the two filters, respectively.

14. The LNG/L-CNG hydraulic pressurization device according to claim 1, wherein the ball valve, which is integrated to a third valve plate, has four connection ports.

15. The LNG/L-CNG hydraulic pressurization device according to claim 1, wherein a first shutoff valve is provided at the oil inlet of the first hydraulic pump, and wherein a second shutoff valve is provided at the oil inlet of the second hydraulic pump.

16. The LNG/L-CNG hydraulic pressurization device according to claim 1, wherein a bottom of the oil tank is further provided with an oil drain ball valve.

17. An LNG/L-CNG filling station, comprising a skid-mounted frame and the LNG/L-CNG hydraulic pressurization device according to claim 1, wherein the LNG/L-CNG hydraulic pressurization device is skid-mounted on the skid-mounted frame.

18. The LNG/L-CNG filling station according to claim 17, wherein the oil tank communicates with an oil return pipeline, the oil return pipeline communicates with the oil return port of the first directional valve and the oil return port of the second directional valve, and a first overflow valve is connected between the oil return pipeline and the oil inlet of the first directional valve.

19. The LNG/L-CNG filling station according to claim 18, wherein a second overflow valve is connected between the oil return pipeline and the oil inlet of the second directional valve.

20. The LNG/L-CNG filling station according to claim 19, wherein the first directional valve, the second directional valve, the first overflow valve, and the second overflow valve are integrated onto a first valve plate.

* * * * *